United States Patent [19]

Speer

[11] Patent Number: 4,927,137

[45] Date of Patent: May 22, 1990

[54] STILT

[76] Inventor: Charles R. Speer, 14014 Briar Pl., Houston, Tex. 77077

[21] Appl. No.: 217,157

[22] Filed: Jul. 11, 1988

[51] Int. Cl.[5] ..... A63B 25/00

[52] U.S. Cl. ..... 272/70.1

[58] Field of Search ..... 128/80 R, 80 B, 80 C; 272/70, 70.1, 70.4, 114; 135/65; D21/72; 36/7.8, 113–116, 81

[56] References Cited

U.S. PATENT DOCUMENTS

| | | | |
|---|---|---|---|
| 438,830 | 10/1890 | Yagn | 272/70 |
| 2,733,065 | 1/1956 | Barkschat | 36/115 X |
| 2,783,997 | 3/1957 | Gaffney et al. | 272/70.1 |
| 2,835,493 | 5/1958 | Skaggs et al. | 272/70.1 |
| 3,102,272 | 9/1963 | Emmert | 272/70.1 |
| 3,557,782 | 1/1971 | Wafer | 272/70.1 X |
| 3,660,920 | 5/1972 | Spina | 272/70.1 X |
| 4,570,926 | 2/1986 | Ensmenger | 272/70.1 |

*Primary Examiner*—Richard J. Apley
*Assistant Examiner*—H. Flaxman
*Attorney, Agent, or Firm*—Bill B. Berryhill

[57] ABSTRACT

A stilt for use in paris to elevate the user thereof. Each stilt includes a ground engaging portion attached to the lower end of an elongated upstanding support. A foot support assembly is attached to the elongated support at a vertically elevated position from the ground engaging portion. The foot support assembly is attached to the elongated support by a single pivot connection. The ground engaging portion is attached to the elongated support by a single pivot connection. The elongated support may be attached to the user's leg when the user's foot is supported on the foot support assembly.

18 Claims, 1 Drawing Sheet

STILT

BACKGROUND OF THE INVENTION

1. Field of the Invention

The present invention pertains to devices for elevating the user thereof above the ground. More specifically, it pertains to stilt devices providing means by which the feet of a user may be vertically elevated above the ground for work or amusement.

2. Brief Description of the Prior Art

Stilts, sometimes referred to as "Tom Walkers", have long been used by children and adults as amusement devices. A simple stilt of the prior art included a long wooden pole or stick to which a foot platform was attached at some vertically elevated distance from the ground. The user would place each foot on a platform of one of a pair of such stilts. The pole would usually extend to somewhere near the shoulder of the user. Such stilts were quite awkward and attempts were made to refine the construction thereof. An example of an early refined stilt construction is shown in U.S. Pat. No. 1,613,535.

In a somewhat related area, foot elevating devices have also been developed for artificial limbs or for individuals having one leg shorter than the other. An example of such a device is shown in U.S. Pat. No. 2,736,902.

In more recent years, stilts or leg extension devices have been developed for workers who need to be elevated to some extent above the ground or floor. For example, such devices have been utilized by sheetrock installers, plasterers and painters to eliminate or reduce the use of scaffolds and ladders. Such devices may be seen in U.S. Pat. Nos. 2,802,217; 2,832,079; 3,058,120; 3,102,272; 3,346,882; 4,255,822; 4,569,516. While most of these devices appear to be useful in their intended purpose, they are primarily utility devices lacking the flexibility, versatility and mobility desired for amusement devices.

SUMMARY OF THE PRESENT INVENTION

In the present invention an improved stilt is disclosed which is especially designed for amusement purposes. Specifically, it is primarily designed for the amusement of children. However, it can be used for amusement of adults as well as for utility uses.

The stilt of the present invention includes a ground or floor engaging assembly, an elongated support assembly attached to the ground engaging assembly and a foot support assembly attached to the support assembly. The foot support assembly, of course, is for supporting the foot of a user at a vertically elevated position above the ground when the ground engaging assembly is engaging the ground with the support assembly extending along the user's leg for attachment thereto. The support assembly may include a first support section between the ground engaging assembly and the foot support assembly and a second support section above the foot support assembly. The second support section preferably includes a pair of substantially parallel elongated support members, one for disposition along the inner side of the user's leg and one for disposition along the outer side of the user's leg.

A unique feature of the stilt of the present invention is the attachment of the ground engaging assembly and the attachment of the foot support assembly to the support assembly, each being attached to the support assembly by single pivot connections. Such connections result in a stilt which is much more versatile and mobile than those of the prior art. In addition, biasing apparatus connects the ground engaging and the foot support assemblies tending to bias them toward mutually parallel positions.

The unique construction of the stilt of the present invention, like those of the prior art, is effective in elevating the user thereof above the ground or the floor. However, in addition, a greater amount of versatility and mobility is provided in a relatively safe manner. The stilt of the present invention is therefore especially suitable as an amusement device. Other features thereof help make it safe for children. Many other objects and advantages of the invention will be apparent from reading the description which follows in conjunction with the accompanying drawings.

DESCRIPTION OF A PREFERRED EMBODIMENT

Figure 2:
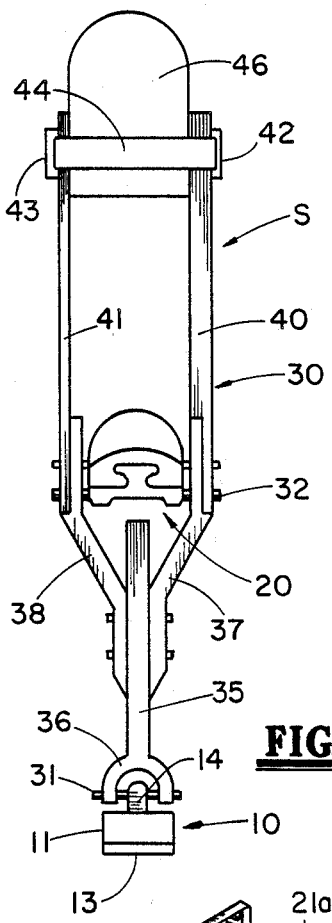
FIG. 2 is a front elevation view of a stilt, according to a preferred embodiment of the invention.
Figure 1:
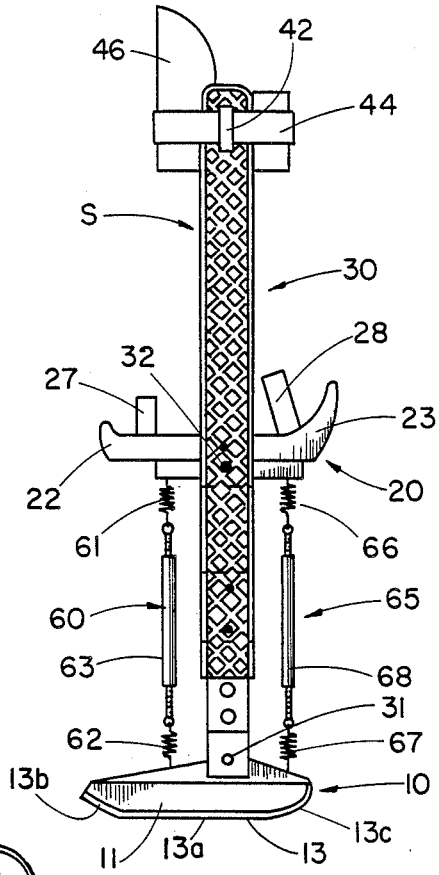
FIG. 1 is a side elevation view of a stilt, according to a preferred embodiment of the invention.

Referring first to FIGS. 1 and 2, there is shown a stilt S according to a preferred embodiment of the invention. The stilt S would actually be used in pairs for elevating the user thereof. The stilt of FIGS. 1 and 2, illustrated for the left leg, includes a ground or floor engaging assembly 10, foot support assembly 20 and an elongated support assembly 30.

Figure 3:
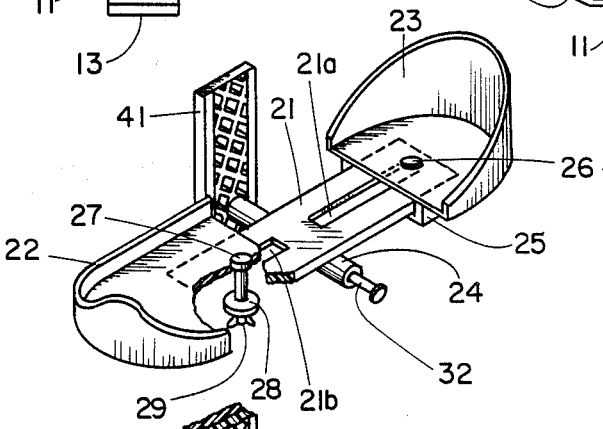
FIG. 3 is an enlarged partial perspective view of the stilt of FIGS. 1 and 2.
Figure 3:
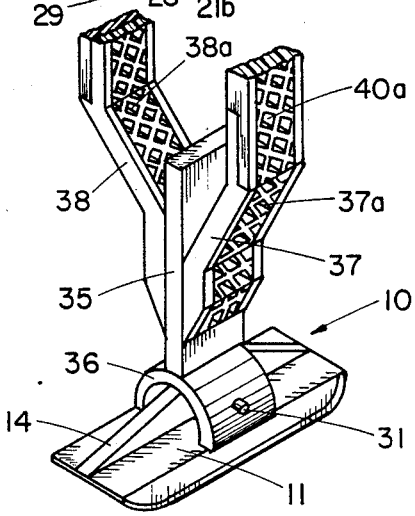

The ground or floor engaging assembly 10 may be made of any suitable shape. As shown in the drawings, (see also FIG. 3) it includes an elongated foot-like member 11 having a downwardly facing support surface 13 for contact with the ground. The support surface 13 has a relatively flat intermediate area 13*a* at opposite ends of which are curved toe and heel surfaces, 13*b*, 13*c* respectively. All of the support surface 13 may be provided or covered with a friction engaging material. Extending upwardly along the elongated member 11 is a rib 14 having a hole therein for receiving a pin 31 providing a pivot connection between support assembly 30 and the ground or floor engaging assembly 10.

Supported on a similar pin 32 carried by in the support assembly 30 is the foot support assembly 20. Of course, the foot support assembly 20 is for supporting the foot of a user at a vertically elevated position above the ground engaging assembly 10. The foot assembly preferably comprises a central portion 21, toe portion 22 and heel portion 23. The central portion 21 is provided with a horizontal tubular member 24 through which the pin 32 extends for supporting the foot support assembly 20 on the support assembly 30. Pairs of angle pieces 25 etc. are welded to the underside of the heel portion 23 and the toe portion 22 (not shown for toe portion) providing channels for slidingly receiving opposite ends of central portion 21. Bolts or screws 26, 27, through holes in the heel and toe portions 23, 22, respectively, engage corresponding slots 21*a* and 21*b* of the central portion 21 and are provided with washers 28 and wing nuts 29. Loosening of the nuts 29 allow the toe and heel pieces 22, 23 to be selectively positioned, shortening or lengthening the foot support assembly to accommodate different size feet of users thereof. This may also be useful in balancing the foot support assembly about the pin 32. Straps 27 and 28 may be provided to attach the user's foot to the foot support assembly 20.

Connecting the forward portions of the ground engaging assembly 10 and the foot support assembly 20 is a first spring assembly 60 which includes spring 61, 62 and a turnbuckle 63. Connecting the rearward portions of the ground engaging assembly 10 and foot support assembly 20 is a second spring assembly 65 including springs 66, 67 and turnbuckle 68. The tension on the spring assemblies 60 and 65 may be adjusted by adjustment of the turnbuckles 63, 68. The spring assemblies 60 and 65 tend to bias the ground engaging assembly 10 and the foot support assembly 20 toward mutually parallel positions. Shortening of either one of the first and second spring assemblies 60, 65 is opposed by the other.

The support assembly 30 may be said to be comprised of two sections, a first section between the ground engaging assembly 10 and the foot support assembly 20 and a second section above the foot support assembly 20. The first support section may include an elongated member 35 at the lower end of which is provided a clevis 36 having holes through which pin 31 passes for providing the single pivot connection between the support assembly 30 and the ground engaging assembly 10. The upper portion of the lower support section may include a pair of upwardly extending arm members 37, 38 between which the foot support assembly 20 is disposed at its pivot connection 32. The second support section of the support assembly 30 includes substantially parallel elongated support members 40, 41, one of which 41 is for disposition along the inner side of the user's leg and the other of which 40 is for disposition along the outer side of the user's leg. Both of the support members 40 and 41 are longitudinally rigid. The outer member 40 is also preferably laterally rigid. However, the inner member 41 may be thinner and may be designed with some lateral flexibility so as to allow the inner members 41 to conform closely to the leg. It will be noted that the outer member 40 as well as the arms 38 and 37 of the lower section are shown of a structural material having support ribs 40*a*, 38*a*, 37*a* which make the material strong but light.

The support members 40 and 41 may be provided with loops 42, 43 for receiving a strap 44 to encircle the user's leg for attaching the support members 40 and 41 thereto. Preferably the strap 44 is provided with some type Velcro closure member. In addition, a knee pad 46 may be attached to the support assembly for protecting the user's knee.

To use, the foot support assembly 20 is simply adjusted to the proper length. The stilt S is attached to the foot and leg of the user by the straps 27, 28 and 44. The user can then walk on the stilts, the ground engaging assembly 10 contacting the ground or floor in the manner of a foot. The unique single pivot connections 31 and 32 and the spring assemblies 60, 65 work together to position the foot on the foot support 20 at positions corresponding with the ground engaging assembly 10. With this construction, the stilt S is extremely versatile and mobile and should function so that the user is much more comfortable and natural in movement than with stilts of the prior art. The stilts of the present invention are especially desirable for use as an amusement device.

While a single embodiment of the invention has been described herein, many variations thereof can be made without departing from the spirit of the invention. Accordingly, it is intended that the scope of the invention be limited only by the claims which follow.

I claim:

1. A stilt to be used in pairs for elevating the user thereof comprising: ground or floor engaging means, elongated support means attached to said ground engaging means, said support means including means for attachment to the user's leg, and a foot support assembly attached to said support means for supporting a foot of said user at a vertically elevated position from said ground engaging in which each of said ground engaging means and said foot assembly is attached to said support means by single pivot connections, one pivot connection for each, the single pivot connection for said foot assembly supporting the load on said foot assembly and the single pivot connection for said ground engaging means supporting the load on said ground engaging means, and biasing means connecting said ground engaging means and said foot support assembly tending to bias said ground engaging means and said foot support assembly toward mutually parallel positions.

2. A stilt as set forth in claim 1 in which each of said ground engaging means and said foot support assembly has a forward portion and a rearward portion generally on opposite sides of its corresponding single pivot connection.

3. A stilt to be used in pairs for elevating the user thereof comprising: ground or floor engaging means, elongated support means attached to said gound engaging means, said support means including means for attachment to the user's leg, and a foot support assembly attached to said support means for supporting a foot of said user at a vertically elevated position from said ground engaging means, each of said ground engaging means and said foot assembly being attached to said support means by a single pivot connection, each of said ground engaging means and said foot support assembly having a forward portion and a rearward portion generally on opposite sides of its corresponding single pivot connection and including first spring means connecting the forward portion of said ground engaging means and the forward portion of said foot support assembly and second spring means connecting the rearward portion of said ground engaging means and the rearward portion of said foot support assembly.

4. A stilt as set forth in claim 3 in which at least one of said spring means comprises a first spring and a second spring connected by a turnbuckle assembly whereby the tension applied to said springs may be selectively adjusted.

5. A stilt as set forth in claim 3 in which the shortening of either one of said first and second spring means is opposed by the other.

6. A stilt as set forth in claim 1 in which said support means comprises a first support section supporting the load of said stilt between said single pivot connections of said ground engaging means and foot support assembly, respectively, and a second support section above said foot support assembly, said second support section comprising a pair of substantially parallel elongated support members, one for disposition along the inner side of the user's leg and one for disposition along the outer side of the user's leg.

7. A stilt as set forth in claim 6 in which said attachment means by which said support means is attached to the user's leg is fastened to said pair of support members.

8. A stilt as set forth in claim 7 in which said attachment means comprises a strap encircling the user's leg.

9. A stilt as set forth in claim 7 including a knee pad attached to said pair of support members for protecting the user's knee.

10. A stilt as set forth in claim 6 in which one of said parallel support members is both longitudinally and laterally rigid and the other of which is longitudinally rigid but has some lateral flexibility to allow said members to conform closely to said leg.

11. A stilt as set forth in claim 6 in which said first support section has an elongated lower portion to one end of which said ground engaging means is attached by its single pivot connection and an upper portion which includes a pair of upwardly extending arm members between which said foot support assembly is attached by its said single pivot connection.

12. A stilt to be used in pairs for elevating the user thereof comprising: ground or floor engaging means; elongated support means for substantially vertical disposition during use and to the lower end of which said floor engaging means is pivotally connected; and a foot support assembly pivotally connected to said support means at a vertically spaced position above said ground engaging means, said support means extending upwardly from said foot support assembly for attachment to the leg of said user by attachment means; and biasing means connecting said ground engaging means and said foot support assembly tending to bias said ground engaging means and said foot support assembly toward mutually parallel positions, each of said ground engaging means and said foot support assembly being connected, near midpoints thereof, to said support means by a single pivot connection, each of said ground engaging means and said foot support assembly having forward and rearward portions on opposite sides of said midpoints, said forward portions of said ground engaging means and said foot support assembly and said rearward portions of said ground engaging means and said foot support assembly being connected by first and second assemblies of said biasing means, respectively.

13. A stilt as set forth in claim 12 in which at least one of said first and second assemblies comprises first and second springs connected by a device by which the tension applied to said springs may be selectively adjusted.

14. A stilt as set forth in claim 12 in which said foot support assembly comprises a central portion, a toe portion and a heel portion, both said toe and heel portions being attached to said central portion so as to allow shortening or lengthening of said foot support assembly for accommodating different size feet of the users thereof.

15. A stilt as set forth in claim 12 in which said support means may be selectively shortened or lengthened to accommodate different length legs of the users thereof.

16. A stilt as set forth in claim 12 including a knee pad attached to said support means for protecting the user's knee.

17. A stilt as set forth in claim 12 in which said ground engaging means includes a downwardly facing support surface for contact with said ground or floor, said support surface having a relatively flat intermediate area and at opposite ends thereof a curved toe surface and a curved heel surface.

18. A stilt as set forth in claim 17 in which said support surface is provided with a friction engaging material.

* * * * *